US008151523B2

(12) United States Patent
Epple

(10) Patent No.: US 8,151,523 B2
(45) Date of Patent: Apr. 10, 2012

(54) ELECTRICALLY CONDUCTIVE SWIMMING POOL PANEL

(76) Inventor: Tom Epple, Fort Wayne, IN (US)

( * ) Notice: Subject to any disclaimer, the term of this patent is extended or adjusted under 35 U.S.C. 154(b) by 214 days.

(21) Appl. No.: 12/234,330

(22) Filed: Sep. 19, 2008

(65) Prior Publication Data

US 2009/0077905 A1 Mar. 26, 2009

Related U.S. Application Data

(60) Provisional application No. 60/973,925, filed on Sep. 20, 2007.

(51) Int. Cl.
*E04B 1/00* (2006.01)

(52) U.S. Cl. ..... 52/169.7; 52/309.1; 52/288; 52/169.9

(58) Field of Classification Search ..... 52/107, 52/169.6, 169.7, 288, 309.1, 309.13, 309.16, 52/220.1, 220.2, 220.7; 4/504; 174/51, 5 R, 174/5 SB, 5 SG
See application file for complete search history.

(56) References Cited

U.S. PATENT DOCUMENTS

| | | | | | |
|---|---|---|---|---|---|
| 2,202,013 | A * | 5/1940 | Lougheed | 442/189 |
| 3,144,505 | A * | 8/1964 | Fork | 174/70 R |
| 3,585,656 | A * | 6/1971 | Costello | 4/494 |
| 3,962,675 | A * | 6/1976 | Rowley et al. | 362/101 |
| 4,124,907 | A * | 11/1978 | Laven | 52/169.7 |
| 4,433,366 | A * | 2/1984 | Wade | 362/267 |
| 4,962,285 | A * | 10/1990 | Baker | 174/6 |
| 5,752,860 | A * | 5/1998 | Greaves | 439/781 |
| 6,725,524 | B2 * | 4/2004 | Lin et al. | 29/596 |
| 7,559,431 | B2 * | 7/2009 | Schutz | 220/23.87 |
| 2009/0269530 | A1 * | 10/2009 | Schmidt et al. | 428/36.7 |

* cited by examiner

*Primary Examiner* — William Gilbert
*Assistant Examiner* — Patrick Maestri
(74) *Attorney, Agent, or Firm* — Taylor IP, P.C.

(57) ABSTRACT

A swimming pool includes a plurality of non-metal panels arranged in an end-to-end manner around a periphery of the swimming pool. Each panel includes a non-metal base material, an electrically conductive ground plane, and at least one bonding feature. The bonding features of the plurality of panels are electrically coupled together and bonded to ground.

6 Claims, 4 Drawing Sheets

ELECTRICALLY CONDUCTIVE SWIMMING POOL PANEL

CROSS REFERENCE TO RELATED APPLICATIONS

This is a non-provisional application based upon U.S. provisional patent application Ser. No. 60/973,925, entitled "ELECTRICALLY CONDUCTIVE SWIMMING POOL PANEL", filed Sep. 20, 2007, which is incorporated herein by reference.

BACKGROUND OF THE INVENTION

1. Field of the Invention

The present invention relates to swimming pools, and, more particularly, to non-metal side wall panels for swimming pools.

2. Description of the Related Art

Swimming pools may be made with concrete walls or side wall panels, with side wall panels becoming more and more popular for cost and ease of installation. Side wall panels may be made as metal or non-metal panels which are connected together in an end-to-end manner to define the perimeter of the pool. Non-metal panels may be molded using injection or compression techniques.

It is typically a requirement that metal pool panels be ground bonded to eliminate the possibility of shock to users, such as may occur in the event of an electrical failure at an underwater light, etc. Further, the bonded metal pool panels pick up any stray electrical currents in the ground that may result from a damaged underground electrical wire in the area.

With a pool having non-metal walls, the metal parts of the pool such as perhaps a metal ingress/egress ladder, slide legs, metal tracks for an automatic cover, etc. are likewise bonded. Since the walls are not bonded, it is possible for electrical currents to pass through into the water in the pool.

What is needed in the art is a swimming pool with non-metal wall panels which are bonded to ground.

SUMMARY OF THE INVENTION

The present invention provides a swimming pool with non-metal panels forming a ground plane which is bonded to ground.

The invention in one form is directed to a swimming pool panel, including a non-metal panel comprised of a plastic base material; and an electrically conductive ground plane associated with the panel. The ground plane includes at least one bonding feature for bonding the panel with a ground.

The invention in another form is directed to a swimming pool, including a plurality of non-metal panels arranged in an end-to-end manner around a periphery of the swimming pool. Each panel includes a non-metal base material, an electrically conductive ground plane, and at least one bonding feature. The bonding features of the plurality of panels are electrically coupled together and bonded to ground.

An advantage of the present invention is that the non-metal panels are bonded to ground.

Another advantage is that stray electrical currents into the swimming pool are inhibited.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
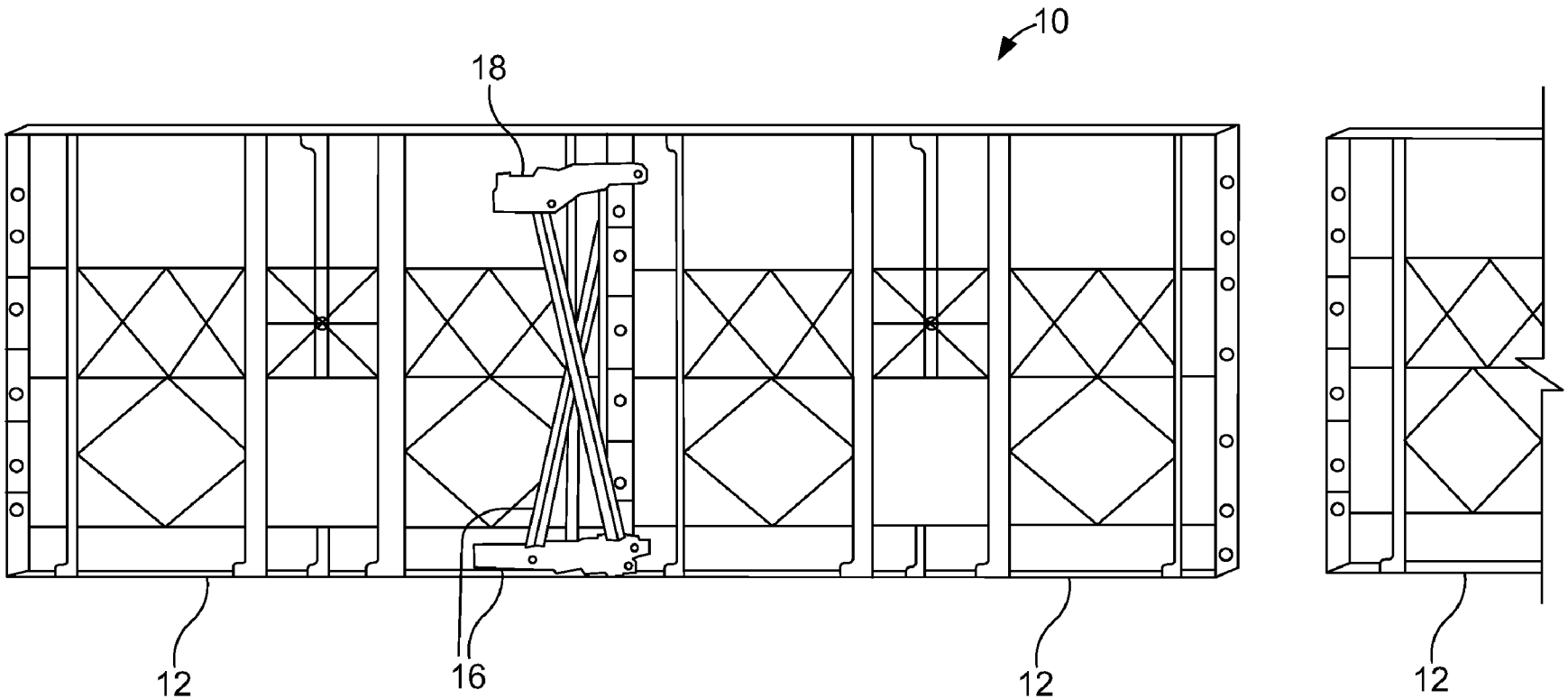
FIG. 1 is a perspective view of an embodiment of a swimming pool panel of the present invention.
Figure 2:
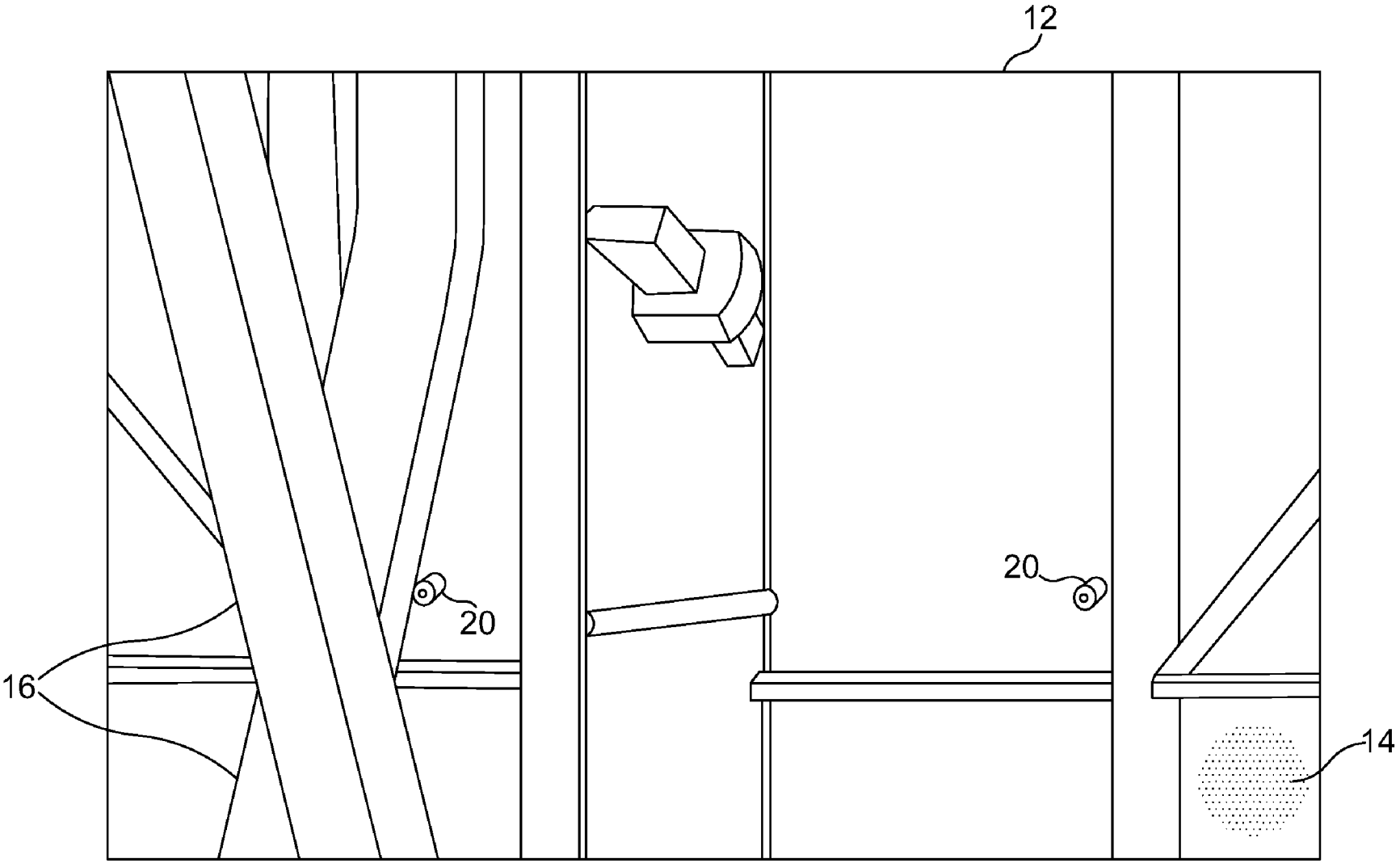
FIG. 2 is a detailed view showing the bonding interconnection between the adjacent panels of FIG. 1.

Referring now to the drawings, and more particularly to FIGS. 1 and 2, there is shown a portion of an embodiment of a swimming pool 10 of the present invention, including a plurality of non-metal panels 12 arranged in an end-to-end manner and forming the perimeter walls of swimming pool 10. Panels 12 include an electrically conductive ground plane for bonding the plurality of non-metal panels 12 with ground, and thereby inhibiting stray electrical currents from entering swimming pool 10. The ground plane may be defined in different ways.

For example, in the embodiment shown in FIGS. 1 and 2, panels 12 may be formed from a non-metal base material which is preferably an electrically conductive plastic material, such as BD-811D or 833C manufactured by Thyssen Krupp-Budd Company as a sheet molding compound (SMC) for compression molding. The 833C conductive plastic has the following physical characteristics:

| Property | ASTM Test Method | Typical Molded Specification | Metric Equivalent |
|---|---|---|---|
| Specific Gravity | D-792-98 | 1.87 | 1.87 |
| Water Absorption (24 Hours @ 23° C.) | D-570-98 | <0.35% | <0.35% |
| Heat Distortion Temp. ° F., 264 PSI | D-648-98 | >450° F. | >235° C. |
| Barcol Hardness | D-2583-95 | 55 | 55 |
| Impact Strength (Izod Ft. Lbs./In/Notched) | D-256-97 | 19 | 1.06 KJ/m |
| Flexural Strength, PSI | D-790-98 | 36,500 | 250 MPa |
| Flexural Modulus (PSI × $10^6$) | D-790-98 | 1.6 | 11.0 GPa |
| Compressive Strength, PSI | D-695-96 | 27,000 | 189 MPa |
| Tensile Strength, PSI | D-638-98 | 16,000 | 112.6 |
| Mold Shrinkage (Cold Piece from Cold Mold, In./In.) | | +0.0001 | +0.0001 cm/cm |
| Coefficient of Expansion (75° F.-300° F.) | D-696-98 | $7.77 \times 10^{-6}$ in./in./° F. | $14.0 \times 10^{-6}$ cm/cm/° F. |
| Fiberglass Content | | 40% | 40% |

Other types of conductive plastics suitable for compression or injection molding are also available and may be used with the present invention. For example, the plastic may include conductive particles at a predetermined density within the plastic base material (see, e.g., reference number 14 in FIG. 2)

The support braces 16 and decking braces 18 shown in FIGS. 1 and 2 are composite, non-metal braces, and therefore it is necessary to provide one or more bonding features 20 which act as an electrical interface with the electrically conductive panels 12. Referring more specifically to FIG. 2, each bonding feature may be in the form of an electrical coupler 20 which is inserted into the mold and provides an interface for bonding between the panels 12 and to ground. The size and configuration of the electrical coupler 20 may vary depending upon factors such as the panel configuration and the type of molding process used (e.g., compression or injection).

Panels 12 can be electrically bonded together using other suitable techniques. For example, each electrical coupler 20 may include a threaded nut or stud extending from a small plate which is adhesively bonded to the back side of a panel using an electrically conductive adhesive on the metal plate.

Figure 3:
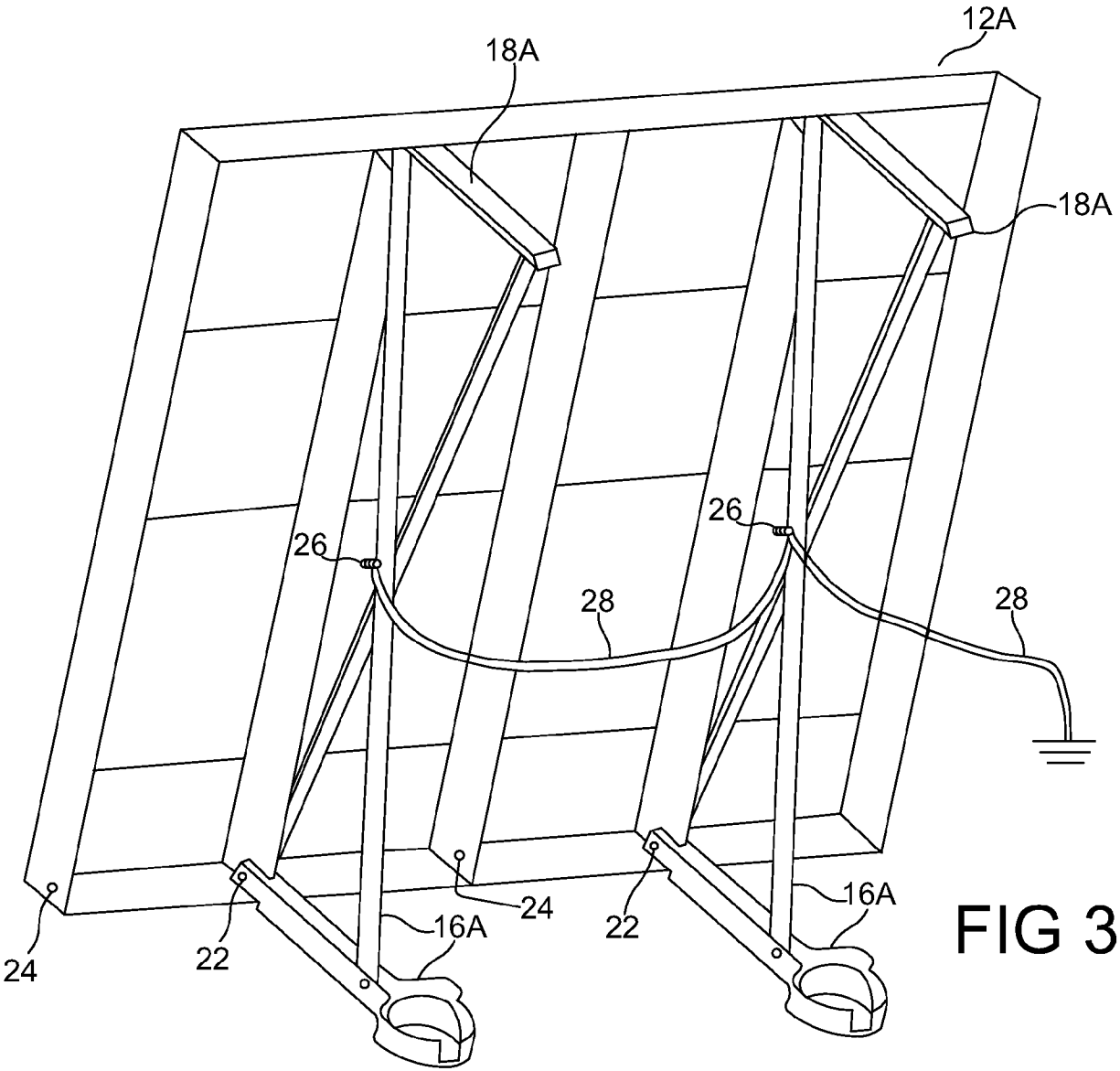
FIG. 3 is a perspective view of another embodiment of a swimming pool panel of the present invention.

Referring now to FIG. 3, there is shown another embodiment of a swimming pool panel 12A which includes electrically conductive, non-metal panels and metal support braces 16A and decking braces 18A at the back side which are arranged in a generally X configuration. Braces 16A, 18A are mechanically and electrically coupled with the conductive panels 12A using bonding features in the form of suitable metal fasteners 22 which pass through selected through-holes 24 in panels 12A. Since panels 12A are electrically conductive, the integrally formed through-holes provide a convenient way of electrically coupling with panels 12A. Panels 12A are connected to each other at the junction between the cross braces using suitable metal fasteners 26 and bonding wire 28. The bonding wire 28 can be attached to the metal braces 16A, 18A at any of the fastener locations.

Figure 5:
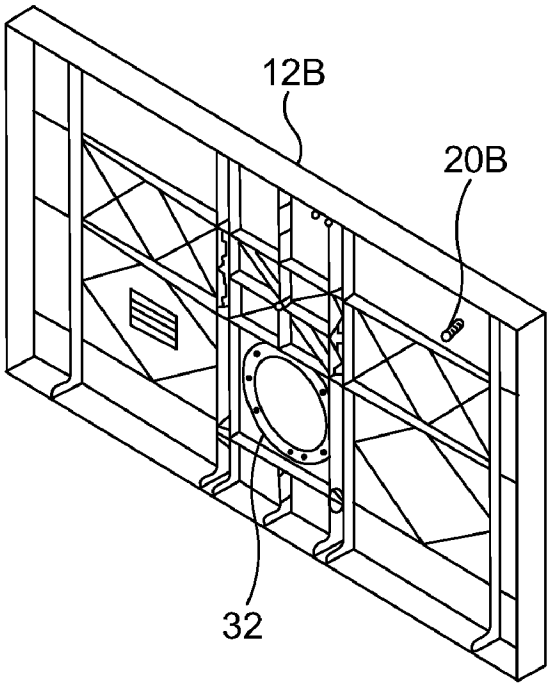
FIG. 5 is a perspective view of the swimming pool panel shown in FIG. 4.
Figure 4:
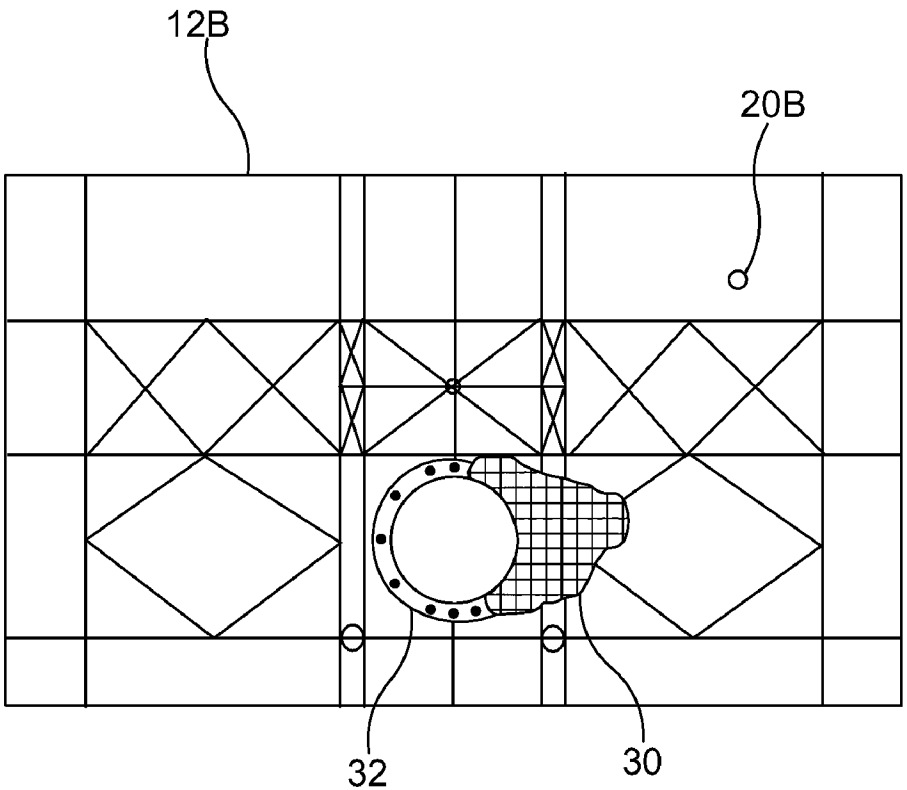
FIG. 4 is a front view of yet another embodiment of a swimming pool panel of the present invention.

Referring now to FIGS. 4 and 5, there is shown another embodiment of a swimming pool panel 12B which includes electrically non-conductive, non-metal panels and an electrically conductive mesh 30 within the panel. With a typical non-metal panel, electrical stray currents can be conducted into the water within the pool through metal bolts or the like which extend through the panel walls, such as through the bolt holes surrounding the underwater light flange 32 shown in FIGS. 4 and 5. The metal mesh 30 within the panel (shown in the fragged out panel to the right of the light flange in FIG. 4) extends into the flange area and electrically couples with the bolts around the light flange. The metal mesh 30 is attached to the bonding feature in the form of a metal bolt 20B shown in the top, right corner of the panel, which in turn is used for bonding the panels to each other and/or to ground. Any stray currents passing through the bolts are thus bonded to ground and do not enter the water within the pool.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A swimming pool panel, comprising:

a non-metal molded panel comprised of a non-metal base material;

an electrically conductive ground plane associated with said panel, said ground plane including at least one bonding feature for bonding said panel with a ground, each said bonding feature being accessible at an exterior of each respective said panel, said ground plane including an electrically conductive mesh embedded within said panel and attached to at least one said bonding feature; and an underwater light assembly including an underwater light flange and a plurality of bolts located around said underwater light flange and connecting said underwater light flange to said panel, said mesh being electrically coupled with said plurality of bolts and thereby electrically coupling said plurality of bolts with said bonding feature to bond said plurality of bolts with said ground.

2. The swimming pool panel of claim 1, wherein said base material is a conductive plastic defining said ground plane.

3. The swimming pool panel of claim 2, wherein said conductive plastic includes a plurality of conductive particles suspended within said plastic base material.

4. A swimming pool, comprising:

a plurality of non-metal molded panels arranged in an end-to-end manner around a periphery of the swimming pool, each said panel including a non-metal base material, an electrically conductive ground plane, and at least one bonding feature, said bonding features of said plurality of panels being accessible at an exterior of each respective said panel, electrically coupled together and bonded to ground, said ground plane including an electrically conductive mesh embedded within at least a respective one of said plurality of panels and attached to at least one respective said bonding feature of said respective one of said plurality of panels, said respective one of said plurality of panels including an underwater light assembly including an underwater light flange and a plurality of bolts located around said underwater light flange and connecting said underwater light flange to said respective one of said plurality of panels, said mesh being electrically coupled with said plurality of bolts and thereby electrically coupling said plurality of bolts with said respective bonding feature to bond said plurality of bolts with said ground.

5. The swimming pool of claim 4, wherein said base material is a conductive plastic defining said ground plane.

6. The swimming pool of claim 5, wherein said conductive plastic includes a plurality of conductive particles suspended within said plastic base material.

* * * * *